US008714164B2

(12) United States Patent
Darjania

(10) Patent No.: US 8,714,164 B2
(45) Date of Patent: May 6, 2014

(54) METHOD AND APPARATUS FOR CAPTURING FINGERNAIL CLIPPINGS

(71) Applicant: Gurami Darjania, Coralville, IA (US)

(72) Inventor: Gurami Darjania, Coralville, IA (US)

( * ) Notice: Subject to any disclaimer, the term of this patent is extended or adjusted under 35 U.S.C. 154(b) by 0 days.

(21) Appl. No.: 13/947,452

(22) Filed: Jul. 22, 2013

(65) Prior Publication Data

US 2014/0026915 A1 Jan. 30, 2014

Related U.S. Application Data

(60) Provisional application No. 61/676,371, filed on Jul. 27, 2012.

(51) Int. Cl.
*A45D 29/00* (2006.01)

(52) U.S. Cl.
USPC ..... 132/73; 132/285

(58) Field of Classification Search
USPC ..... 132/73, 73.5, 285; D28/62
See application file for complete search history.

(56) References Cited

U.S. PATENT DOCUMENTS

| | | | | |
|---|---|---|---|---|
| 736,671 | A | 8/1903 | Aksila | |
| 868,641 | A | 10/1907 | Clark | |
| 1,307,256 | A | 6/1919 | Jacobson | |
| 1,671,112 | A | 5/1927 | Hilland | |
| 1,837,045 | A | 12/1929 | Henderson | |
| 2,245,523 | A | 6/1941 | Bernhardt | |
| 2,251,392 | A | 8/1941 | Bernhardt | |
| 2,836,322 | A | 5/1958 | Barnes | |
| 4,246,944 | A | 1/1981 | Dixie | |
| 4,626,291 | A | 12/1986 | Natale | |
| 4,817,644 | A | 4/1989 | Holmes et al. | |
| 4,942,432 | A | 7/1990 | Mort et al. | |
| 4,967,775 | A * | 11/1990 | Kaiser | 132/73 |
| 5,020,710 | A | 6/1991 | Meszaros | |
| 6,149,252 | A | 11/2000 | Browning | |
| 2009/0114242 | A1 * | 5/2009 | Dang | 132/285 |

* cited by examiner

*Primary Examiner* — Rachel Steitz
(74) *Attorney, Agent, or Firm* — Simmons Perrine Moyer Bergman PLC

(57) ABSTRACT

The present invention includes method and apparatus for aiding in the trimming of fingernails and provides a fabric cone with slits in the side for putting hands inside the cone and a transparent top cover over the large part of the cone so that a person can trim their fingernails while inside the fabric cone and observe the process through the transparent cover and retain within the cone any flying fingernail fragments that might otherwise be causing problems.

9 Claims, 2 Drawing Sheets

METHOD AND APPARATUS FOR CAPTURING FINGERNAIL CLIPPINGS

FIELD OF THE INVENTION

The present invention relates to improved systems and methods of capturing fingernail clippings.

BACKGROUND OF THE INVENTION

One common occurrence, while clipping fingernails, is causing small fingernail clippings to fly through the air. These nail clippings can strike a person in the eye causing pain, irritation or even worse. These nail clippings can fly to other unwanted places where they are difficult to locate or remove. Toenail clippings are similarly troublesome. Manicure salons, where many people have their fingernails trimmed daily, have larger problems with cleaning up errant, airborne nail clippings so as to maintain a hygienic environment.

The present invention overcomes one or more of these problems.

SUMMARY OF THE INVENTION

It is an object of the present invention to reduce the time required to clean up nail clippings, shavings and smaller nail portions after nail trimming has occurred.

It is a feature of the present invention to provide a low cost, and portable, system for capturing nail clippings.

It is an advantage of the present invention to reduce the time required to clean up after a nail trimming session and reduce the potential of damage or injury caused by flying nail fragments.

The present invention is designed to achieve the above mentioned objectives, include the previously stated features and provide the aforementioned advantages.

The present invention comprises:

A system for capturing and disposal of nail clippings comprising:

- conical shaped fabric container means configured for receiving therein a plurality of appendages, and for containing therein nail clippings separated from one of said plurality of appendages;
- wire loop means configured for holding open a larger diameter portion of said container means;
- fabric flap means for selectively opening an exit port to said container means;
- where said means for selectively opening permits nail clippings to be removed from said container means;
- snap means for securing said fabric flap means into a position for closing said exit port; and
- transparent cover means configure for enclosing said larger diameter portion of said container means so that an inside of said container means is visible from outside said container means.

DETAILED DESCRIPTION

Figure 1:
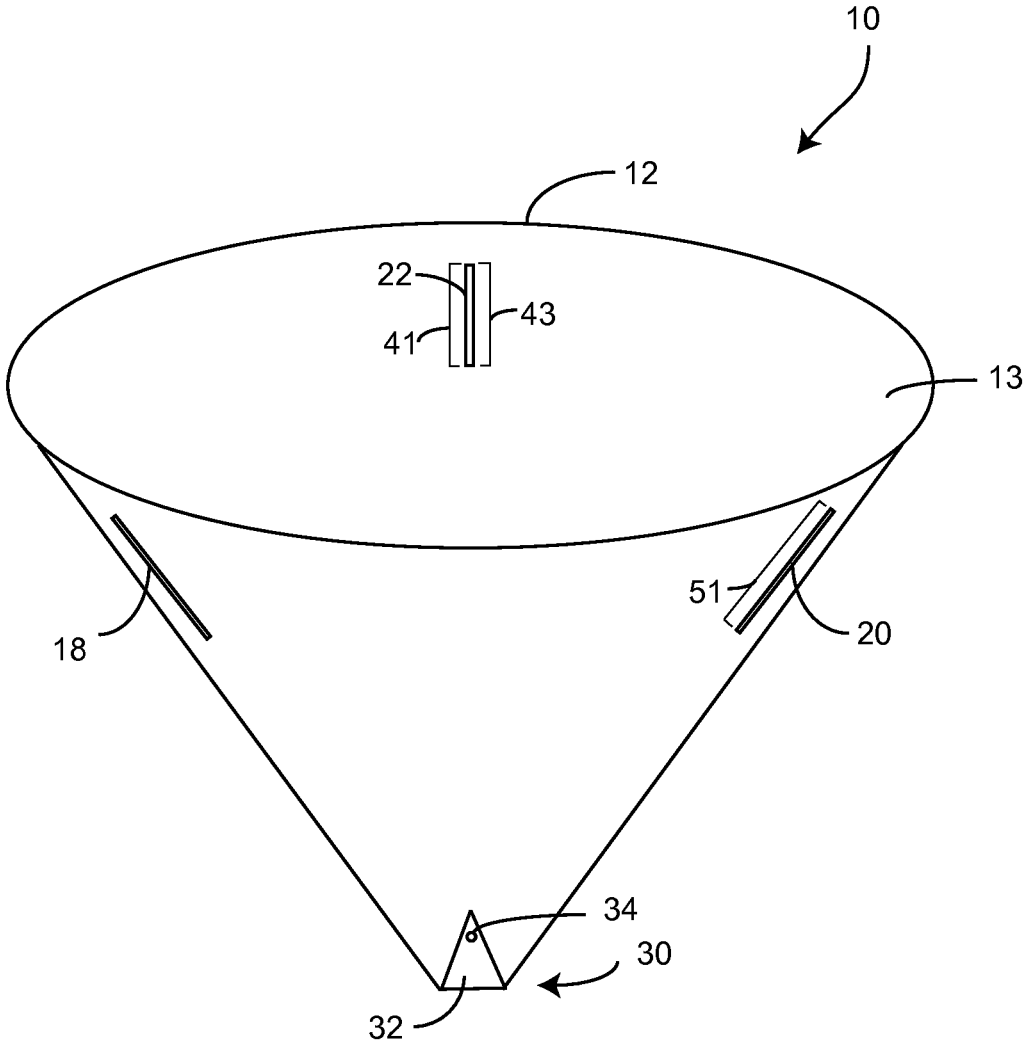
FIG. 1 shows an apparatus of the present invention.

Now referring to the drawings wherein like numerals refer to like structure shown in the drawings and text included in the application throughout.

Now referring to FIG. 1, there is shown a nail capturing container 10 of the present invention, having a top portion and nail clipping catcher bottom portion 30. Fabric can be used to create a conical shaped container with flexible sides but having a well defined top portion and having a peripheral edge 12. The fabric can also be any suitable material depending upon the particular application, including but not limited to a plastic, paper, mesh, woven material, thin layers of material or the like. Disposed over the top portion of the internal cone volume, defined by the fabric, is a transparent top cover 13, which may be a flexible plastic sheeting material or other suitable less flexible and/or removable rigid top cover. In the fabric sides, there are three openings. First appendage receiving opening 18 may be a simple slit (hemmed or un-hemmed) in the fabric, which is sized and configured for a person to insert a hand or a foot therethrough. Similarly, there is shown a second appendage receiving opening 20, which may have an adhesive 51 or other matter configured to help keep the opening closed when desired, e.g. when nothing is inserted therethrough. Third appendage receiving opening 22 is shown disposed generally opposite the other two openings. Third appendage receiving opening 22 is shown having a loop 41 and hook 43 (or vice versa) closure system, such as Velcro, for assisting in maintaining a closed state when nothing is inserted therethrough, or to minimize the opening around a small appendage so as to reduce the potential for nail clippings to fly through a gap around the appendage and the third appendage receiving opening 22. The openings 18, 20, and 22 may be equally separated by 120 degrees, or two may be separated by between 120 degrees and 145 degrees, with the opposite opening being centrally located with respect to each. Other suitable separations are desirable as well. The nail clipping catcher bottom portion 30 is configured to be closed while nails are being clipped and then opened up to remove the nail clippings. Flap 32 may be a portion of fabric of the side material, which is folded upward and held upward by the snap 34. Still other structures could be used, such as a sliding valve or any suitable means for selectively opening and closing the nail clipping catcher bottom portion 30.

Figure 2:
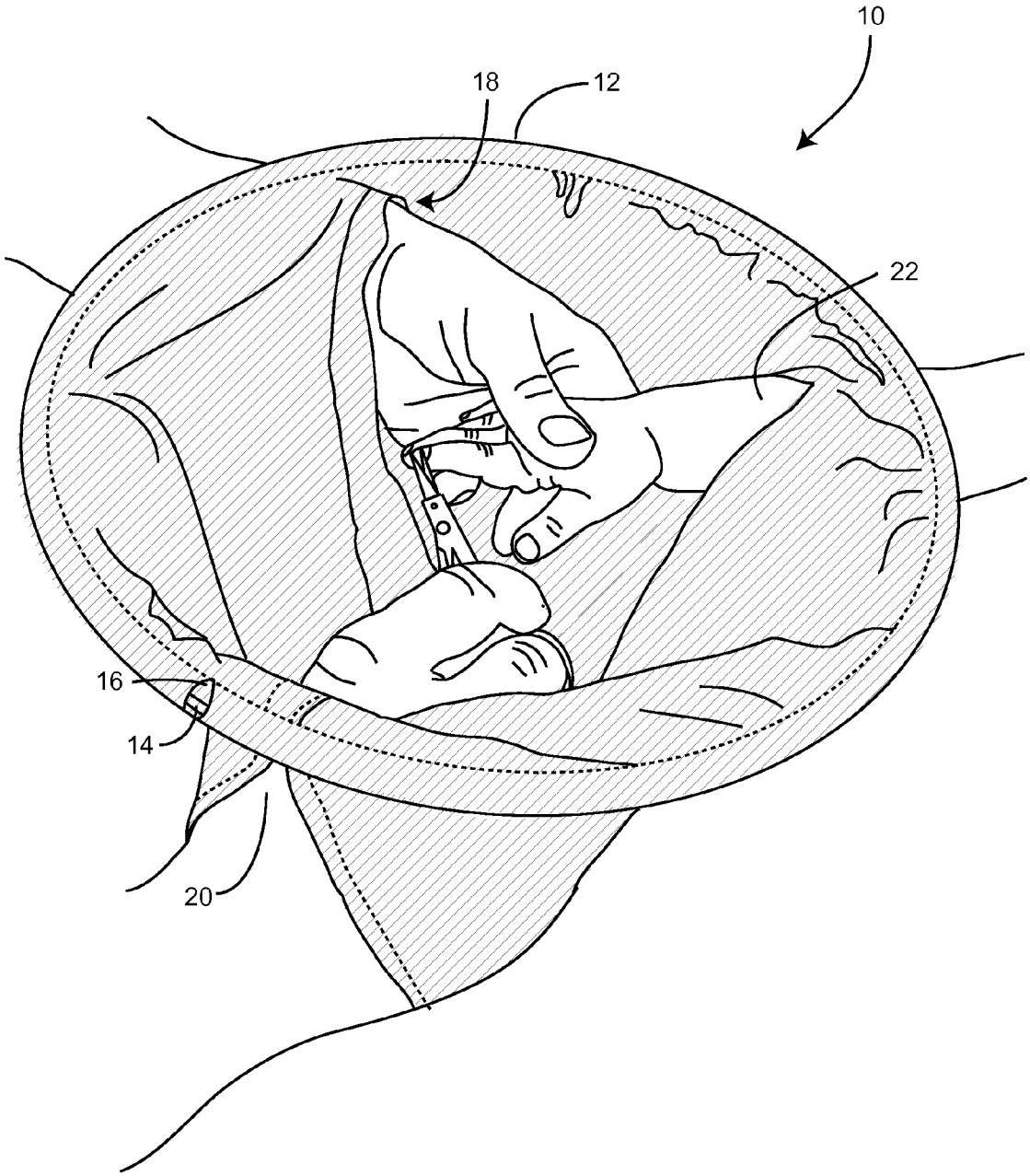
FIG. 2 shows an apparatus similar to that shown in FIG. 1 being used in the processing of trimming a child's fingernails.

Now referring to FIG. 2, there is shown a top view of the nail capturing container 10 of the present invention, which shows two adult hands and one hand of a child. The adult is trimming the child's fingernails by holding the child's hand with one hand and using a tool, such as a manicure scissors, nail clipper, fingernail file, emory board or other suitable manicure or pedicure tools. It should be understood that the child's hand need not be a hand and may be a foot of a child or a hand or foot of an adult.

The nail capturing container 10 can be constructed with a peripheral structural support 14, which may be a wire, a flexible elongated piece of plastic or other suitable structure for holding the fabric apart and defining a peripheral edge 12. The peripheral structural support 14 may be located within a peripheral structure containing pouch 16 or hemmed portion. The transparent top 13 may be sewn in or be removably placed over the top of the peripheral edge 12. Transparent top 13 is shown as being invisible but may be configured to allow for clear or less than totally clear visual inspection of the interior portion of the nail capturing container 10.

The nail capturing container 10 of the present invention could be utilized in various different ways including but not limited to:

Trimming a person's own fingernails as follows:

The nail clipping catcher bottom portion 30 is closed if it is configured to be opened and closed. In the alternative, nail clipping catcher bottom portion 30 could always be closed and the transparent top 13 could be removable or the bottom portion 30 could be pulled from inside to the outside through one of the openings 18, 20 and 22.

The person inserts both hands into the nail capturing container 10, each hand through one of the openings 18, 20 and 22.

The person uses a tool inside the nail capturing container to trim nails or do other manicure or pedicure actions 10, while the person looks through the transparent top 13. The fabric sides of nail capturing container 10 capture any nail clippings, skin, or matter removed by the tool.

The person completes the manicure or pedicure session and removes the hands from the openings.

The nail clippings, or other matter removed from the hands, is then removed from the interior of the nail capturing container 10.

In an alternate embodiment of the method of the present invention, the same person may insert their own foot, or the foot of another person may be inserted through the remaining hole, and then toenails can be clipped or other pedicure actions taken.

Similarly, the method of the present invention works well with trimming fingernails of another person, including a child, where the other person's hand is inserted through the remaining unoccupied opening The present system and method can be used for trimming claws of non-human animals as well. Throughout this description the term "nail clipping" has been used, and is hereby defined to mean pieces of nails and/or claws and/or skin which are removed from an appendage of an animal by a clipper, trimmer, scissors, file, emory board and/or other devices used for manicures, pedicures and/or animal claw trimming.

It is thought that the method and apparatus of the present invention will be understood from the foregoing description, and that it will be apparent that various changes may be made in the form, construct steps, and arrangement of the parts and steps thereof, without departing from the spirit and scope of the invention, or sacrificing all of their material advantages. The form herein described is merely a preferred exemplary embodiment thereof.

What is claimed is:

1. A system for capturing and disposal of nail clippings comprising:

a conical shaped fabric container configured for receiving therein a plurality of appendages, and for containing therein nail clippings separated from one of said plurality of appendages;

a wire loop configured for holding open a larger diameter portion of said container;

a fabric flap for selectively opening an exit port to said container;

where said fabric flap permits nail clippings to be removed from said container;

means for securing said fabric flap into a position for closing said exit port; and a transparent cover configured for enclosing said larger diameter portion of said container so that an inside of said container is visible from outside said container.

2. The system of claim 1 wherein said container is sewn to said transparent cover and sewn about said wire loop.

3. The system of claim 2 wherein container comprises fabric having a plurality of openings therein for receiving said plurality of appendages.

4. The system of claim 3 wherein said plurality of openings comprises three openings disposed around a perimeter of said container, where each of said openings is separated from another of said three openings by at least 100 degrees of arc around said perimeter.

5. The system of claim 4 wherein each of said three openings is free of any structure configured to selectively hold closed an opening.

6. The system of claim 5 wherein said three openings are slits cut into a single piece of fabric.

7. The system of claim 3 wherein one of said plurality of openings has a means for reducing a size characteristic of an opening.

8. The system of claim 7 wherein said means for reducing comprises a fabric comprising a plurality of hooks and a fabric comprising a plurality of loops where said plurality of hooks and said plurality of loops tend to remain in contact unless forced apart.

9. A system for capturing and disposal of nail clippings comprising:

conical shaped fabric container configured for receiving therein a plurality of appendages, and for containing therein nail clippings separated from one of said plurality of appendages;

a wire loop configured for holding open a larger diameter portion of said container;

a fabric flap for selectively opening an exit port to said container;

where said fabric flap permits nail clippings to be removed from said container;

a snap for securing said fabric flap into a position for closing said exit port;

a transparent cover configured for enclosing said larger diameter portion of said container so that an inside of said container is visible from outside said container;

wherein said container is sewn to said transparent cover and sewn about said wire loop;

wherein container comprises fabric having a plurality of openings therein for receiving said plurality of appendages;

wherein said plurality of openings comprises three openings disposed around a perimeter of said container, where each of said openings is separated from another of said three openings by at least 100 degrees of arc around said perimeter;

wherein each of said three openings is free of any structure configured to selectively hold closed an opening;

wherein said three openings are slits cut into a single piece of fabric;

wherein one of said plurality of openings comprises a fabric comprising a plurality of hooks and a fabric comprising a plurality of loops where said plurality of hooks and said plurality of loops tend to remain in contact unless forced apart.

* * * * *